US011512545B2

(12) United States Patent
Yuan et al.

(10) Patent No.: US 11,512,545 B2
(45) Date of Patent: Nov. 29, 2022

(54) DOWNHOLE CHECK VALVE ASSEMBLY WITH A RATCHET MECHANISM

(71) Applicant: Halliburton Energy Services, Inc., Houston, TX (US)

(72) Inventors: Min M. Yuan, Katy, TX (US); Stephen A. Yeldell, Humble, TX (US); Lonnie C. Helms, Humble, TX (US); Frank Acosta, Spring, TX (US); Kevin W. Ardoin, Spring, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 16/960,790

(22) PCT Filed: Feb. 27, 2018

(86) PCT No.: PCT/US2018/020009
§ 371 (c)(1),
(2) Date: Jul. 8, 2020

(87) PCT Pub. No.: WO2019/168503
PCT Pub. Date: Sep. 6, 2019

(65) Prior Publication Data

US 2021/0062597 A1 Mar. 4, 2021

(51) Int. Cl.
*E21B 23/01* (2006.01)
*E21B 33/129* (2006.01)
*E21B 34/10* (2006.01)

(52) U.S. Cl.
CPC ..... *E21B 23/01* (2013.01); *E21B 33/1294* (2013.01); *E21B 34/10* (2013.01)

(58) Field of Classification Search
CPC ..... E21B 23/01; E21B 21/10; E21B 33/1291; E21B 33/1294; E21B 34/10
See application file for complete search history.

(56) References Cited

U.S. PATENT DOCUMENTS 4,934,459 A * 6/1990 Baugh ..... E21B 23/01 166/380
5,379,835 A 1/1995 Streich
(Continued)

FOREIGN PATENT DOCUMENTS

WO 2016036926 A1 3/2016

OTHER PUBLICATIONS

International Search Report and Written Opinion dated Nov. 27, 2018 for PCT Application No. PCT/US2018/020009 filed Feb. 27, 2018, pp. 21.

*Primary Examiner* — Caroline N Butcher
(74) *Attorney, Agent, or Firm* — K&L Gates LLP

(57) ABSTRACT

Valve systems for inserting into casings used in downhole environments are provided. The valve system includes a mandrel, a check valve assembly, and a setting system. The setting system includes a sealing element, a pair of wedges, and a pair of slips, each located on an outer surface of the mandrel. The wedges are separated from each other by the sealing element. Each wedge includes an inner surface configured to slide along the outer surface of the mandrel and an angled surface having a first set of ratchet teeth. The slips are separated from each other by the pair of wedges. Each slip includes an inner surface having a second set of ratchet teeth configured to engage the first set of ratchet teeth. Also, each slip includes an outer surface having gripping elements configured to grip an inner surface of the casing.

20 Claims, 8 Drawing Sheets

(56) References Cited

U.S. PATENT DOCUMENTS

| | | | | |
|---|---|---|---|---|
| 6,135,208 | A | 10/2000 | Gano et al. | |
| 8,336,616 | B1 | 12/2012 | McClinton | |
| 8,770,276 | B1 | 7/2014 | Nish et al. | |
| 9,103,177 | B2 | 8/2015 | Vanlue | |
| 9,611,715 | B1 | 4/2017 | Smith | |
| 10,577,901 | B2 | 3/2020 | Mineo et al. | |
| 2004/0251025 | A1 | 12/2004 | Giroux et al. | |
| 2008/0073086 | A1 | 3/2008 | Cook | |
| 2013/0008671 | A1* | 1/2013 | Booth | E21B 33/1216 166/386 |
| 2013/0048305 | A1* | 2/2013 | Xu | E21B 23/01 166/376 |
| 2013/0082202 | A1* | 4/2013 | Morrison | E21B 33/14 251/315.01 |
| 2013/0300122 | A1* | 11/2013 | Grubel | F03B 17/06 290/54 |
| 2014/0224477 | A1 | 8/2014 | Wiese et al. | |
| 2015/0068728 | A1 | 3/2015 | Stage et al. | |
| 2015/0285026 | A1* | 10/2015 | Frazier | E21B 33/134 166/120 |
| 2015/0300122 | A1 | 10/2015 | George et al. | |
| 2018/0128070 | A1 | 5/2018 | Chang et al. | |

* cited by examiner

DOWNHOLE CHECK VALVE ASSEMBLY WITH A RATCHET MECHANISM

BACKGROUND

This section is intended to provide relevant background information to facilitate a better understanding of the various aspects of the described embodiments. Accordingly, it should be understood that these statements are to be read in this light and not as admissions of prior art.

Check valves and other floating equipment can be installed above ground within a pipe or casing and used during downhole operations, such as for controlling fluid flow. The check valve is installed into a segment of pipe which is later connected to the casing. The valve is assembled into this segment via concrete, resin, or even threading. Problems may be caused during the downhole operation if a check valve becomes unattached or slips from within the casing.

Therefore, there is a need for a check valve assembly that reliably maintains a gas-tight seal with the inner surface of the casing under relatively high pressures commonly experienced during downhole operations.

BRIEF DESCRIPTION OF THE DRAWINGS

Embodiments of the invention are described with reference to the following figures. The same numbers are used throughout the figures to reference like features and components. The features depicted in the figures are not necessarily shown to scale. Certain features of the embodiments may be shown exaggerated in scale or in somewhat schematic form, and some details of elements may not be shown in the interest of clarity and conciseness.

DETAILED DESCRIPTION

Figure 1:
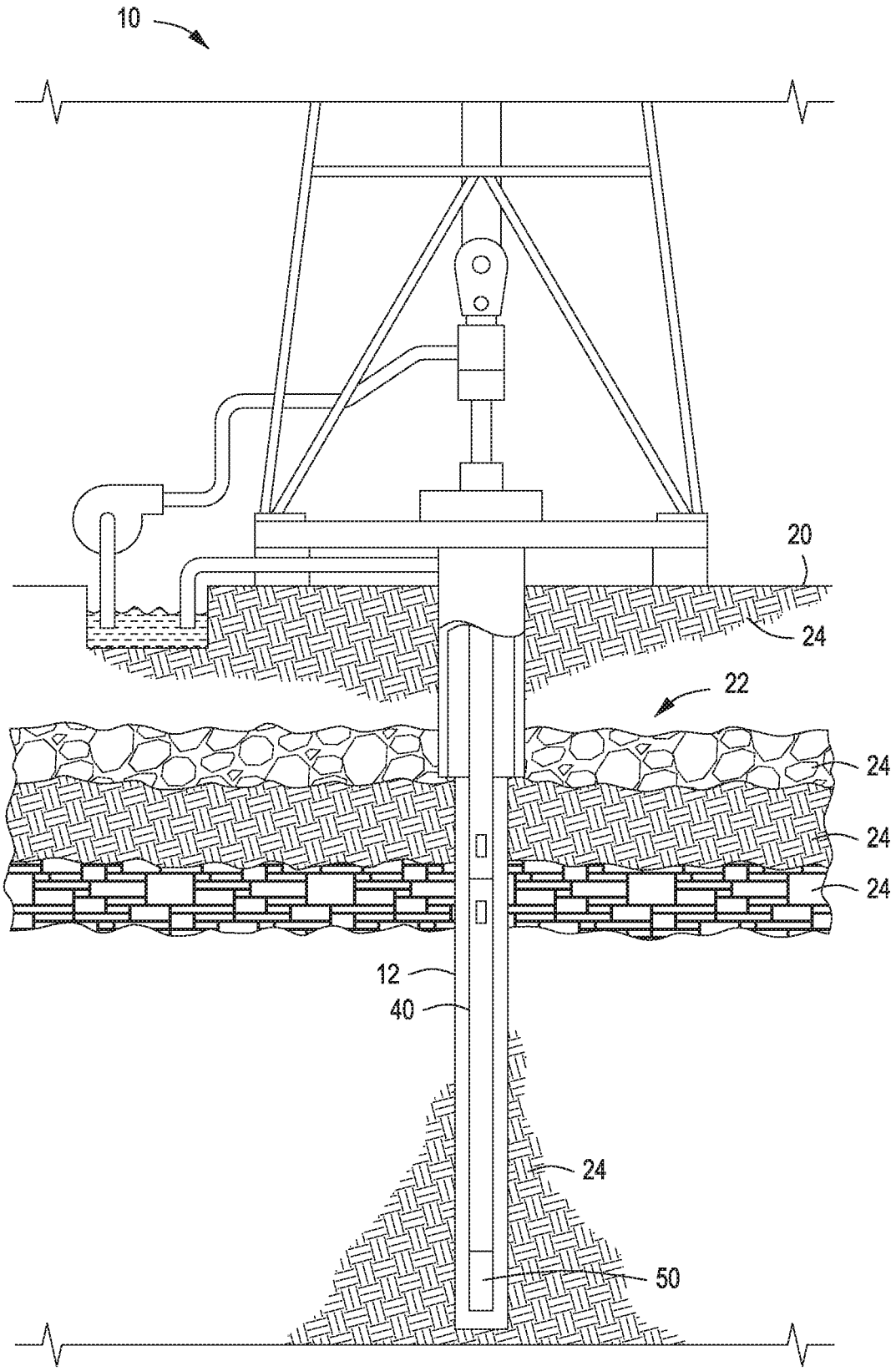
FIG. 1 depicts a schematic view of a well system including a valve system located within a casing in a downhole environment, according to one or more embodiments.

In one or more embodiments, a valve system that is insertable into a casing used in a downhole environment is provided herein. The valve system includes a mandrel, a check or flapper valve assembly, and a setting system. In one embodiment, the setting system includes a sealing element, a pair of wedges, a pair of slips, and a set nut or sleeve, each located on an outer surface of the mandrel. The wedges are separated from each other by the sealing element. Each of the wedges includes an inner surface configured to slide along the outer surface of the mandrel and an angled surface having a first set of ratchet teeth. The slips are separated from each other by the pair of wedges. Each of the slips includes an inner surface having a second set of ratchet teeth configured to engage the first set of ratchet teeth on the angled surface of the wedge. Also, each of the slips includes an outer surface having gripping elements (e.g., buttons or teeth) configured to grip an inner surface of the casing. The set sleeve or similar device (e.g., nose or reamer) is used to axially move the wedges. Upon the relative axial motion of the wedges and the set sleeve, the slips and the sealing element are radially moved towards and engage the inner surface of the casing hence locking the valve system into place within the casing.

In another embodiment, the setting system includes a sealing element, a pair of wedges, a pair of slips, a ratcheting float collar, and a set sleeve, each located on or coupled to the mandrel. Each of the wedges includes an inner surface configured to slide along the outer surface of the mandrel and an angled surface having a relatively smooth surface. Each of the slips includes an inner surface configured to engage and slide along the angled surface of the wedge. Each of the slips also includes an outer surface including gripping elements configured to grip an inner surface of the casing. The ratcheting float collar includes a first set of ratchet teeth for engaging a second set of ratchet teeth located on the mandrel. The set sleeve or similar device is used to ratchet the ratcheting float collar and to axially move the wedges. Upon the relative axial motion of the wedges, the ratcheting float collar, and the set sleeve, the slips and the sealing element are radially moved towards and engage the inner surface of the casing by buttons or teeth, hence locking the valve system into place within the casing.

In another embodiment, the setting system includes a sealing element located on the outer surface of the mandrel and an anchor sleeve located over the threading on the mandrel. An outer sleeve of the anchor sleeve includes a plurality of slip buttons or other gripping elements. The anchor sleeve is configured to be bent outwardly from the mandrel to engage the inner surface of the casing with the slip buttons. In another embodiment, a threaded sleeve is located between the mandrel and the anchor sleeve. A setting tool is used to engage the anchor sleeve and/or the threaded sleeve in an axial motion. Upon the relative axial motion of the sealing element, the anchor sleeve, and the threaded sleeve (if present) are radially moved towards and engage the inner surface of the casing hence locking the valve system into place within the casing.

FIG. 1 depicts a schematic view of a well system 10 including a valve system 50 that is located in a casing 40 placed into a downhole environment, including a subterranean region 22 beneath the ground surface 20, according to one or more embodiments. The valve system 50 can be a check valve, a flapper valve, or another type of valve or flow control device. A string of pipes connected together form the casing 40 that is lowered into a wellbore 12.

The subterranean region 22 includes all or part of one or more subterranean formations, subterranean zones, and/or other earth formations. The subterranean region 22 shown in FIG. 1, for example, includes multiple subsurface layers 24. The subsurface layers 24 can include sedimentary layers, rock layers, sand layers, or any combination thereof and other types of subsurface layers. One or more of the subsurface layers 24 can contain fluids, such as brine, oil, gas, or combinations thereof. The wellbore 12 penetrates through the subsurface layers 24 and although the wellbore 12 shown in FIG. 1 is a vertical wellbore, the valve system 50 can also be implemented in other wellbore orientations. For example, the valve system 50 may be adapted for horizontal wellbores, slant wellbores, curved wellbores, vertical wellbores, or any combination thereof. The valve system 50 can be or include any of the valve systems and/or the check valve assemblies described and discussed below.

Figure 2A:
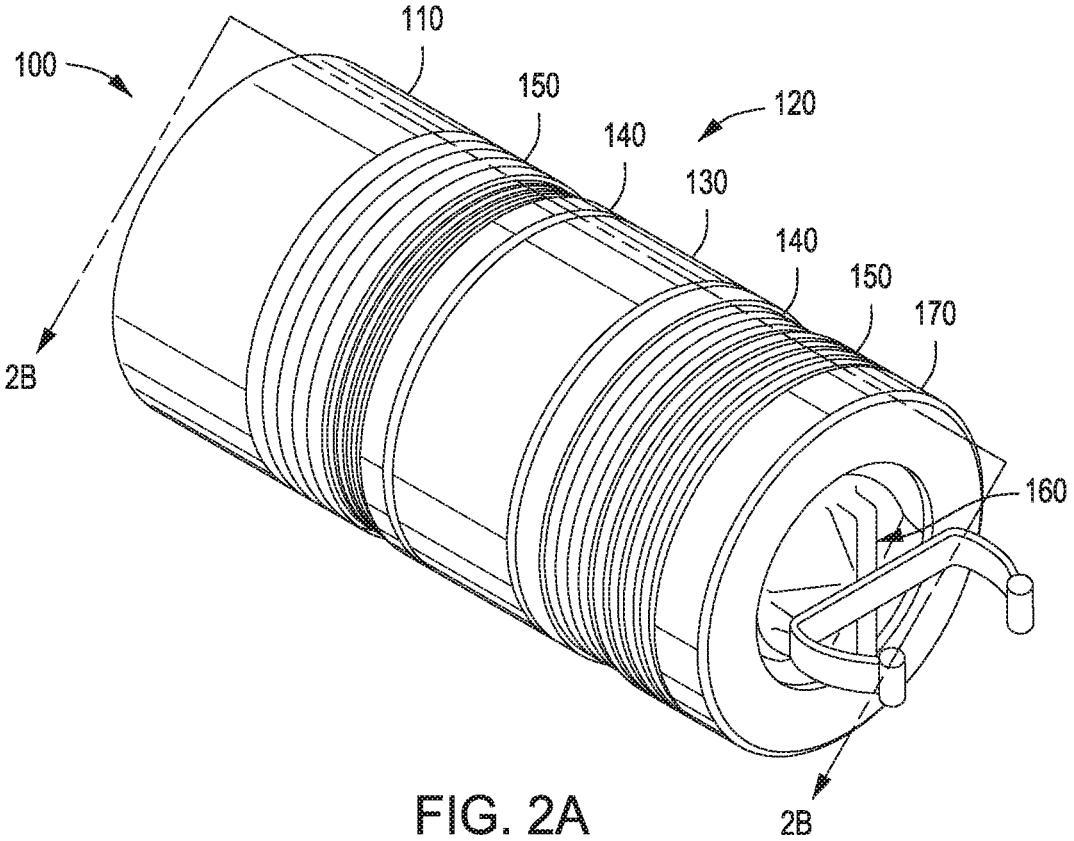
FIGS. 2A and 2B are schematic views of a valve system with a ratchet mechanism and the packer or seal element can be positioned within a casing by a setting sleeve, according to one or more embodiments.
Figure 2B:
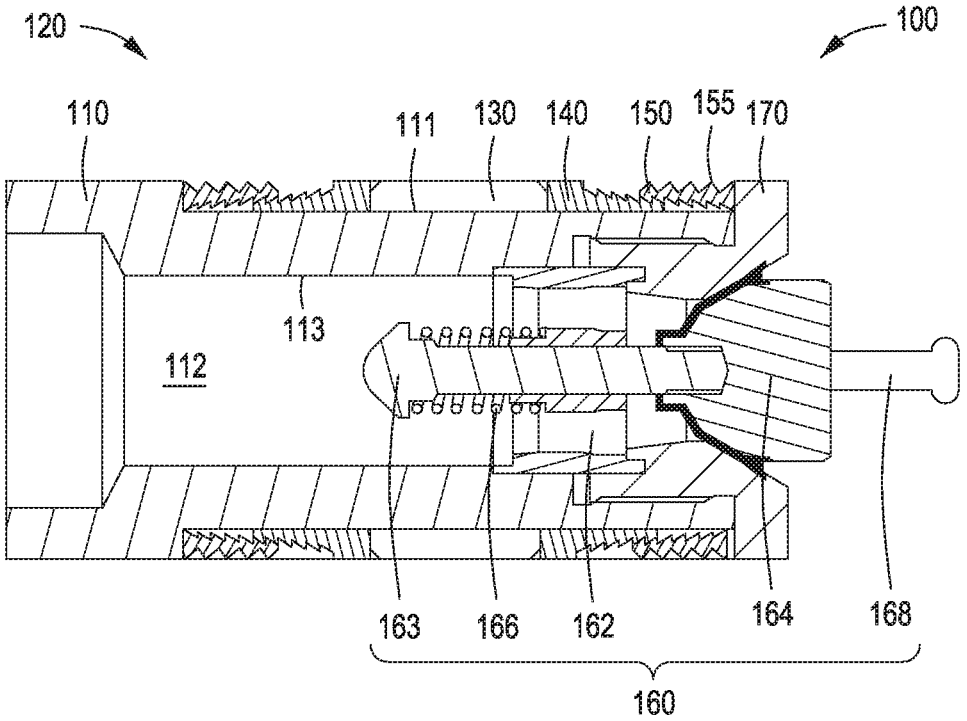

FIGS. 2A and 2B depict a valve system 100 with a ratchet mechanism that can be positioned into a casing that is used in a downhole environment, according to one or more embodiments. The valve system 100 is insertable into the casing or pipe above ground and subsequently, the casing containing the installed valve system 100 is placed into a downhole environment, such as a borehole, a well, and/or a subterranean formation. Alternatively, the valve system 100 can be inserted into and attached inside the casing or pipe that is already positioned in a downhole environment.

The valve system 100 includes a mandrel 110, a setting system 120, and a check valve assembly 160. The setting system 120 includes one or more sealing elements 130, a pair of wedges 140, and a pair of slips 150 located on the mandrel 110. A set sleeve 170 is coupled to the mandrel 110 and is initially used to hold the sealing element 130, the wedges 140, and the slips 150 onto the mandrel 110. As discussed in more detail below, the set sleeve 170 is also used to activate the setting system 120 and lock the valve system 100 into place within a casing. Although the valve system 100 is depicted containing the check valve assembly 160, other types of valves, such as a flapper valve, can substituted for the check valve assembly 160.

As depicted in FIG. 2B, the mandrel 110 includes an outer surface 111 and an inner surface 113. The sealing element 130, the wedges 140, and the slips 150 are located on the outer surface 111. The inner surface 113 defines a passageway 112 extending or otherwise passing through the mandrel 110. The check valve assembly 160 is coupled to the mandrel 110 and configured to provide a fluid flow 201 in a primary direction (depicted by arrows in FIG. 3A) through the passageway 112 and to prohibit the fluid flow 201 in a secondary direction (not shown) through the passageway 112 opposite of the primary direction. The check valve assembly 160 can include a valve body 162, a valve stem 163, a plunger 164, an actuator 166 (e.g., spring), and an engagement member 168. It should be appreciated that the check valve assembly 160 can include other or different components as well.

Figure 3A:
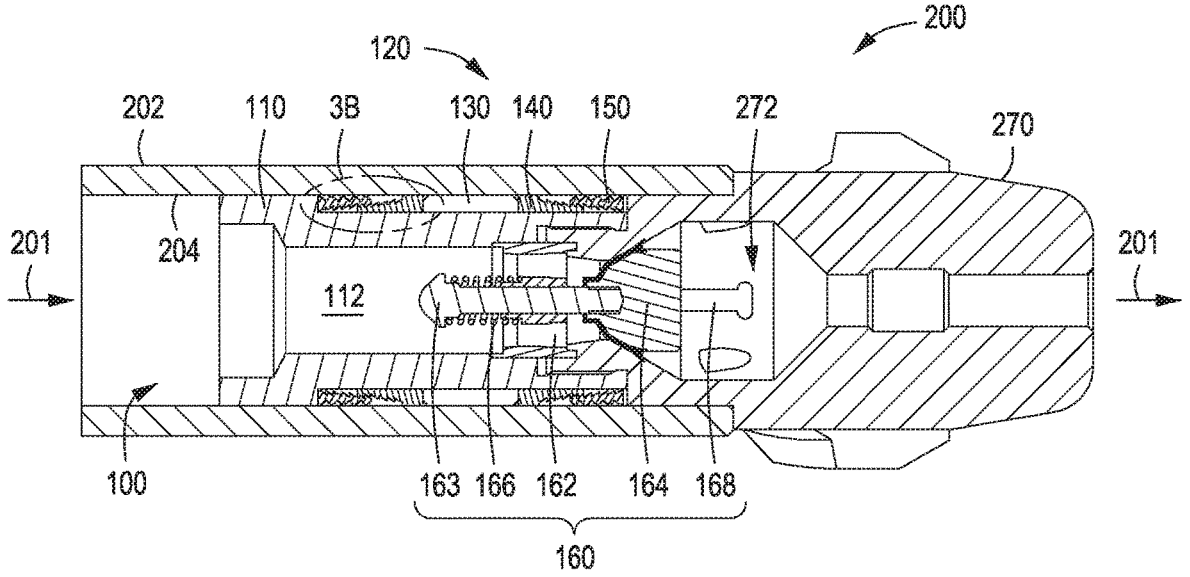
FIGS. 3A and 3B are schematic views of the valve system depicted in FIGS. 2A and 2B positioned in a casing with a reamer according to one or more embodiments.

As shown in FIG. 3A, fluid flowing along the path of the fluid flow 201 in the primary direction exerts sufficient pressure against the plunger 164 to overcome a force pressing the plunger 164 against the valve body 162. The force pressing the plunger 164 against the valve body 162 includes the actuator 166, as well as fluid pressure from outside of the casing produced from a flowing along a path in the secondary direction opposite of the fluid flow 201 in the primary direction. Whenever the pressure from inside the casing is less than the pressure outside of the casing, the actuator 166 and the outside pressure pushes the plunger 164 into sealing engagement with the valve body 162 therefore prohibiting fluid from flowing along the secondary direction.

As depicted in FIGS. 2A and 2B, the valve system 100 includes the set sleeve 170 that is used to contain the setting system 120 on the mandrel 110 and to activate the setting system 120. The setting system 120 is activated with the set sleeve 170 by axially moving the wedges 140 and radially moving the slips 150 and the sealing element 130 to engage the inner surface of the casing and locking the valve system 100 into place within the casing. The ratcheting lock ring or the set sleeve 170 has an orifice in fluid communication with the passageway 112 of the mandrel 110. The set sleeve 170 can be replaced with a reamer or a nose.

Figure 3B:
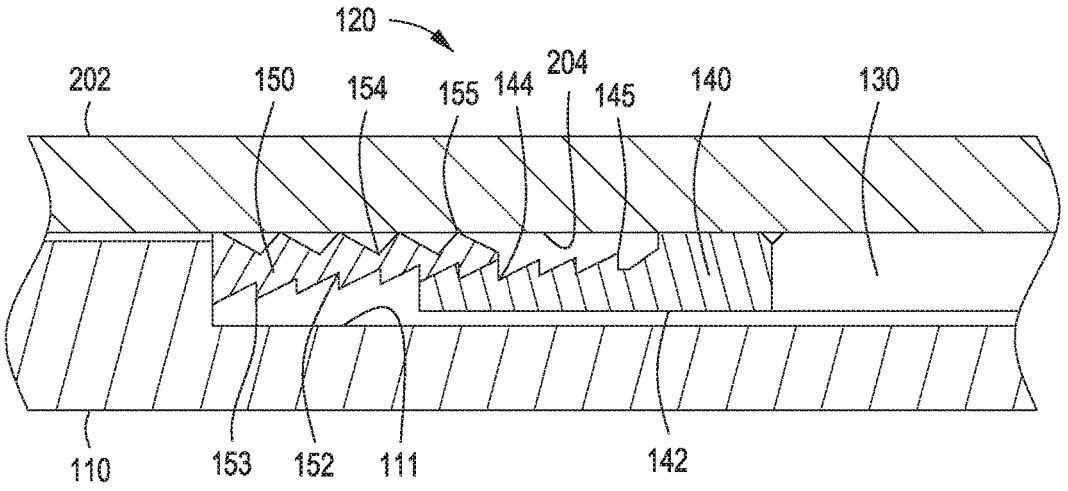

As depicted in FIGS. 3A and 3B, a system 200 includes the valve system 100 positioned within a casing 202 having a reamer 270 instead of the set sleeve 170, according to one or more embodiments. The reamer 270 is used to hold the components of the setting system 120 onto the mandrel 110 and to activate the setting system 120. A passageway 272 extends or passes through the reamer 270 and is in fluid communication with the passageway 112.

Figure 4:
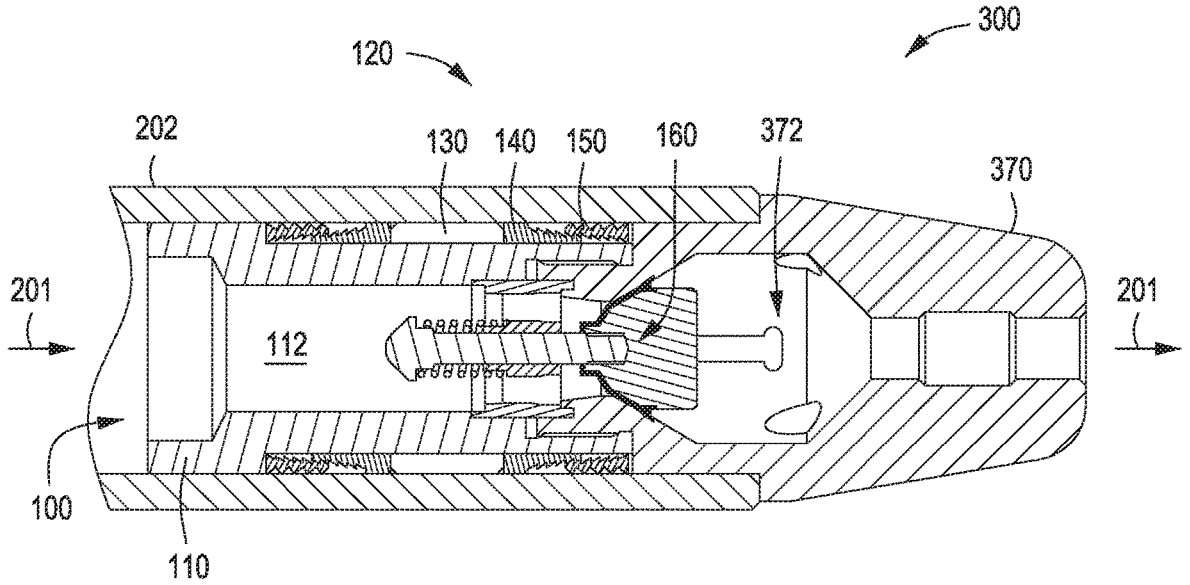
FIG. 4 is a schematic view of the valve system depicted in FIGS. 2A and 2B positioned in a casing with a nose, according to one or more embodiments.

As depicted in FIG. 4, a system 300 includes the valve system 100 positioned within the casing 202 having a nose 370 instead of the set sleeve 170, according to one or more embodiments. The nose 370 is used to hold the components of the setting system 120 onto the mandrel 110 and to activate the setting system 120. A passageway 372 extends or passes through the nose 370 and is in fluid communication with the passageway 112.

The sealing element 130 is located on the outer surface 111 of the mandrel 110. The sealing element 130 can be or include, but is not limited to, one or more O-rings, O-seals, packer elements, or any combination thereof. The sealing element 130 can contain one or more polymers, oligomers, rubbers (natural and/or synthetic), silicones, or any combinations thereof. The sealing element 130 forms a gas-tight seal once in sealing engagement with the inner surface 204 of the casing 202.

The wedges 140 are located on the outer surface 111 of the mandrel 110 and separated from each other by the sealing element 130. The slips 150 are located on the mandrel 110 and separated from each other by the pair of wedges 140. As depicted in FIG. 3B, each of the wedges 140 includes an inner surface 142 configured to slide along the outer surface 111 of the mandrel 110. Each of the wedges 140 also includes an angled surface 144 including a first set of ratchet teeth 145. The ratchet teeth 145 can include threads, such as ratcheting threads. Each of the slips 150 includes an inner surface 152 and an outer surface 154. The inner surface 152 of the slips 150 includes a second set of ratchet teeth 153 configured to engage the first set of ratchet teeth 145 on the angled surface 144 of the wedge 140. The outer surface 154 of the slips 150 includes gripping elements 155 configured to grip an inner surface 204 of the casing 202.

The first and second sets of ratchet teeth 145, 153 form a ratcheting system that radially moves the outer surface 154 of the slips 150 towards the inner surface 204 of the casing 202 as the slip 150 axially moves over the wedge 140. The first and second sets of ratchet teeth 145, 153 are shaped and configured to allow outward radial movement between the slips 150 and disallow inward radial movement of the slips 150. The set sleeve 170 (FIGS. 2A and 2B), the reamer 270

(FIGS. 3A and 3B), or the cone 370 (FIG. 4) is used to axially move the wedges 140. Upon the relative axial motion of the wedges 140, the slips 150 and the sealing element 130 are radially moved towards and engage the inner surface of the casing.

The gripping elements 155 can be or include, but are not limited to, one or more teeth, one or more ridges, one or more threads, or one or more slip buttons. The gripping elements 155 extend from the outer surface of the slip 150. The gripping elements 155 can extend from the slip 150 at an angle (as shown in FIG. 2B), or alternative, the gripping elements 155 can extend perpendicular from the slip 150 (not shown). The gripping elements 155 are shaped so as to be configured to make contact with and grip the inner surface 204 of the casing 202, as shown in FIGS. 3A and 3B. Once in contact, the gripping elements 155 produce enough friction against the inner surface 204 of the casing 202 to hold the valve system 100 into place within the casing 202.

The gripping elements 155 generally contain a material durable enough to withstand the pressures and temperatures experienced downhole in the casing. The gripping elements 155 can contain, but are not limited to, one or more materials that include metal (e.g., cast iron, steel, aluminum, magnesium, or alloys thereof), metal carbide (e.g., tungsten carbide), ceramic, thermoplastic (e.g., phenolic resins or plastic), or any combinations thereof. In one or more examples, the gripping elements 155 are teeth or ridges formed into the slip 150 and contain metal. In other examples, the gripping elements 155 are slip buttons and contain a ceramic. In another embodiment, the gripping elements 155 contain a dissolvable material that can be readily dissolved or deteriorated when exposed to an aqueous fluid, such as a cement or a water-based mud, that is an acidic or alkaline. Exemplary dissolvable materials can be or include, but are not limited to, one or more of aluminum, magnesium, aluminum-magnesium alloy, iron, alloys thereof, degradable polymer, or any combination thereof.

Figure 5:
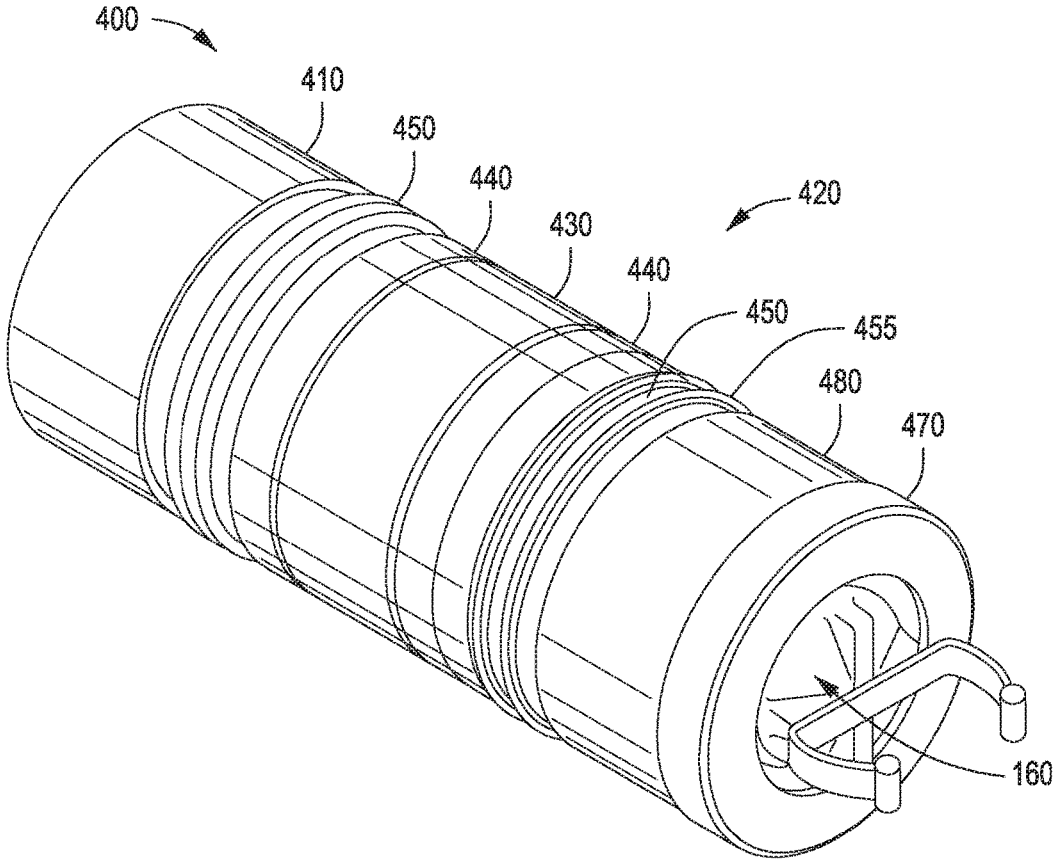
FIG. 5 is a schematic view of another valve system with a ratchet mechanism including a ratcheting float collar that can be positioned within a casing, according to one or more embodiments.

FIG. 5 depicts a valve system 400 with a ratchet mechanism that can be positioned into a casing that is used in a downhole environment, according to one or more embodiments. The valve system 400 is insertable into the casing or pipe above ground and subsequently, the casing containing the installed valve system 400 is placed into a downhole environment, such as a borehole, a well, and/or a subterranean formation. Alternatively, the valve system 400 can be inserted into and attached inside the casing or pipe that is already positioned in a downhole environment.

The valve system 400 includes a mandrel 410, a setting system 420, and the check valve assembly 160. The setting system 420 includes, but is not limited to, one or more sealing elements 430, a pair of wedges 440, a pair of slips 450, a set sleeve 470, and a ratcheting float collar 480. The sealing element 430, the wedges 440, the slips 450, and the ratcheting float collar 480 are located on an outer surface 411 of the mandrel 410. The set sleeve 470 is coupled to the mandrel 410 and is initially used to hold the sealing element 430, the wedges 440, the slips 450, and the ratcheting float collar 480 onto the mandrel 410. As discussed in more detail below, the set sleeve 470 is also used to activate the setting system 420 and lock the valve system 400 into place within a casing. Although the valve system 400 is depicted containing the check valve assembly 160, other types of valves, such as a flapper valve, can substituted for the check valve assembly 160.

Figure 6A:
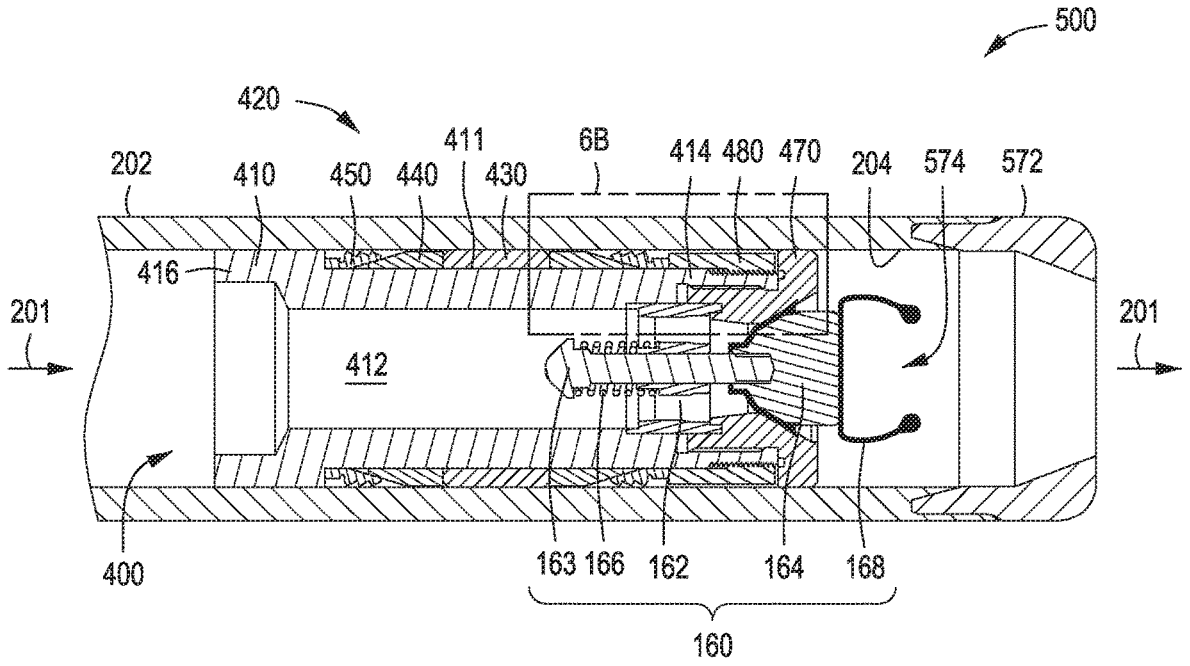
FIGS. 6A and 6B are schematic views of the valve system depicted in FIG. 5 positioned in a casing with a shoe, according to one or more embodiments.
Figure 6B:
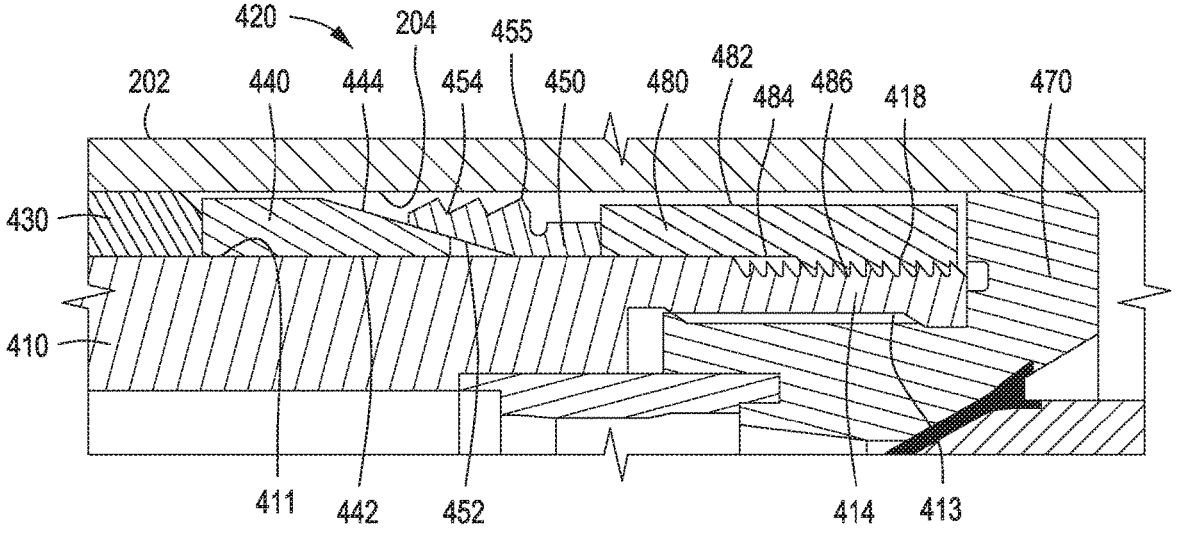

As depicted in FIGS. 6A and 6B, a system 500 includes the valve system 400 positioned in a casing 202 having a shoe 572, according to one or more embodiments. A passageway 574 extends or passes through the shoe 572 and is in fluid communication with the passageway 412 via the check valve assembly 160.

The mandrel 410 includes an outer surface 411 and an inner surface 413. The inner surface 413 defines a passageway 412 extending or otherwise passing through the mandrel 410. The mandrel 410 has one end 414 downstream of another end 416 relative to the fluid flow 201 in the primary direction. The sealing elements 430, the wedges 440, the slips 450, and the ratcheting float collar 480 are located between the end 416 and the set sleeve 470.

The check valve assembly 160 is coupled to the mandrel 410 and configured to provide a fluid flow 201 in a primary direction (depicted by arrows in FIG. 6A) through the passageway 412 and to prohibit the fluid flow 201 in a secondary direction (not shown) through the passageway 412 opposite of the primary direction. The check valve assembly 160 can include a valve body 162, a valve stem 163, a plunger 164, an actuator 166 (e.g., spring), and an engagement member 168.

The sealing element 430 is located on the outer surface 411 of the mandrel 410. The sealing element 430 can be or include, but is not limited to, one or more O-rings, O-seals, packer elements, or any combination thereof. The sealing element 430 can contain one or more polymers, oligomers, rubbers (natural and/or synthetic), silicones, or any combinations thereof. The sealing element 430 forms a gas-tight seal once in sealing engagement with the inner surface 204 of the casing 202.

The wedges 440 are located on the outer surface 411 of the mandrel 410 and separated from each other by the sealing element 430. Each of the wedges 440 includes an inner surface 442 and an angled surface 444. The inner surface 442 is configured to slide along the outer surface 411 of the mandrel 410.

The slips 450 are located on the mandrel 410 and separated from each other by the pair of wedges 440. Each of the slips 450 includes an inner surface 452 and an outer surface 454. The inner surface 452 of the slips 450 can be configured to engage the angled surface 444 of the wedge 440. The angled surfaces 444 of the wedges 440 can be smooth and the inner surfaces 452 of the slips 450 can also be smooth. In some examples, the angled surface 444 is parallel to the inner surface 452. The outer surface 454 of the slips 450 includes gripping elements 455.

The gripping elements 455 can be or include, but are not limited to, one or more teeth, one or more ridges, one or more threads, or one or more slip buttons. The gripping elements 455 extend from the outer surface of the slip 450. The gripping elements 455 can extend from the slip 450 at an angle (as shown in FIGS. 6A and 6B), or alternative, the gripping elements 455 can extend perpendicular from the slip 450 (not shown). The gripping elements 455 that are shaped so as to be configured to make contact with and grip the inner surface 204 of the casing 202, as shown in FIGS. 6A and 6B. Once in contact, the gripping elements 455 produce enough friction against the inner surface 204 of the casing 202 to hold the valve system 400 into place within the casing 202.

The gripping elements 455 generally contain a material durable enough to withstand the pressures and temperatures experienced downhole in the casing. The gripping elements 455 can contain, but are not limited to, one or more materials that include metal (e.g., cast iron, steel, aluminum, magnesium, or alloys thereof), metal carbide (e.g., tungsten carbide), ceramic, thermoplastic (e.g., phenolic resins or plastic), or any combinations thereof. In one or more examples, the gripping elements 455 are teeth or ridges formed into the slip 450 and contain metal. In other examples, the gripping elements 455 are slip buttons and contain a ceramic. In another embodiment, the gripping elements 455 contain a dissolvable material that can be readily dissolved or deteriorated when exposed to an aqueous fluid, such as a cement or a water-based mud, that is an acidic or alkaline. Exemplary dissolvable materials can be or include, but are not limited to, one or more of aluminum, magnesium, aluminum-magnesium alloy, iron, alloys thereof, degradable polymer, or any combination thereof.

The ratcheting float collar 480 is located around at least a portion of the mandrel 410 adjacent to one of the slips 450. The ratcheting float collar 480 has an outer surface 482 and an inner surface 484. The inner surface 484 includes a first set of ratchet teeth 486 for engaging the mandrel 410. The mandrel 410 includes a second set of ratchet teeth 418 located on the outer surface 411 of the mandrel 410. The second set of ratchet teeth 418 of the tool mandrel 410 is shaped so as to be configured to be engaged by the first set of ratchet teeth 486 on the ratcheting float collar 480.

The first set of ratchet teeth 486 and the second set of ratchet teeth 418 form a ratcheting system that is configured to radially move the outer surface 454 of the slips 450 towards the inner surface 204 of the casing 202. The first set of ratchet teeth 486 and the second set of ratchet teeth 418 are configured to allow outwardly radially movement between the slips 450 and disallow inwardly radially movement of the slips 450.

As depicted in FIGS. 6A and 6B, the valve system 400 includes the set sleeve 170 that is used to contain the setting system 420 on the mandrel 410 and to activate the setting system 420. The setting system 420 is activated with the set sleeve 170 by axially moving on the ratcheting float collar 480 and the wedges 440 and radially moving the slips 450 and the sealing element 130 to engage the inner surface of the casing and locking the valve system 400 into place within the casing. The set sleeve 470 has an orifice in fluid communication with the passageway 412 of the mandrel 410. The set sleeve 170 can be replaced with a reamer or a nose, as discussed and described below.

Figure 7:
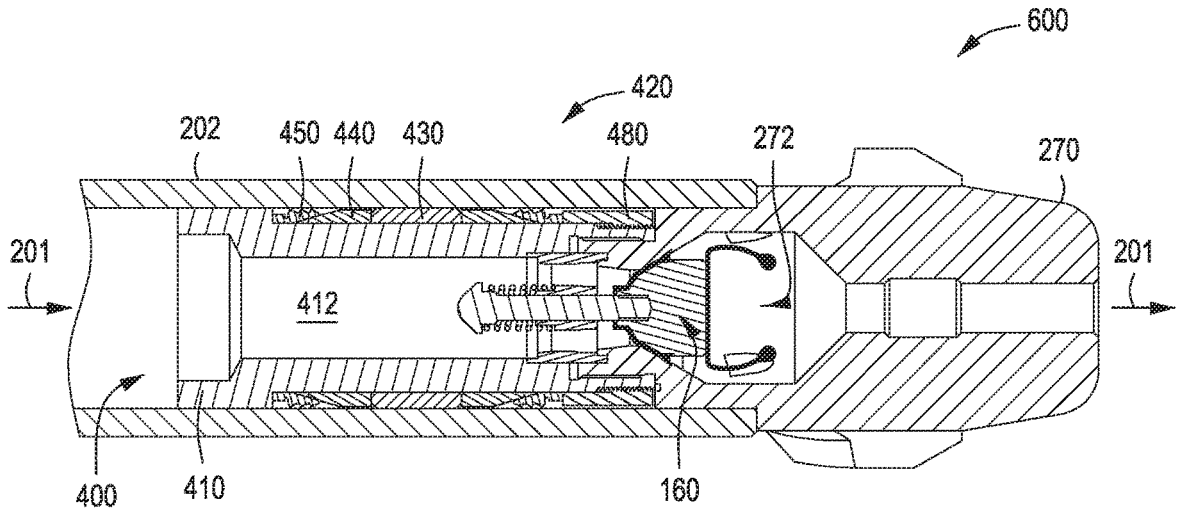
FIG. 7 is a schematic view of the valve system depicted in FIG. 5 positioned in a casing with a reamer, according to one or more embodiments.

As depicted in FIG. 7, a system 600 includes the valve system 400 positioned within a casing 202 having a reamer 270 instead of the set sleeve 470, according to one or more embodiments. The reamer 270 is used to hold the components of the setting system 420 onto the mandrel 410 and to activate the setting system 420. A passageway 272 extends or passes through the reamer 270 and is in fluid communication with the passageway 412.

Figure 8:
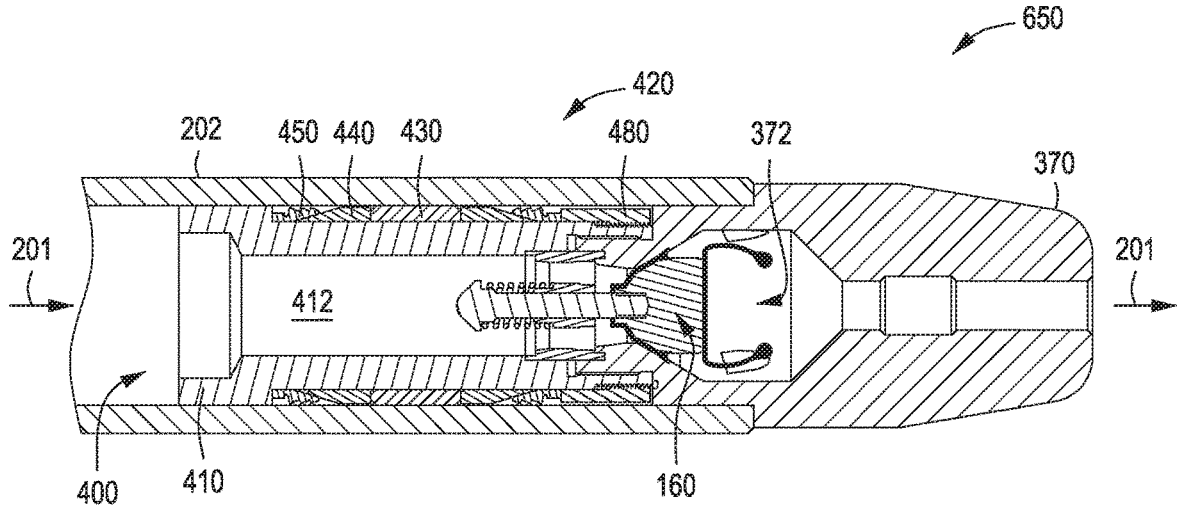
FIG. 8 is a schematic view of the valve system depicted in FIG. 5 positioned in a casing with a nose, according to one or more embodiments.

As depicted in FIG. 8, a system 650 includes the valve system 400 positioned within the casing 202 having a nose 370 instead of the set sleeve 470, according to one or more embodiments. The nose 370 is used to hold the components of the setting system 420 onto the mandrel 410 and to activate the setting system 420. A passageway 372 extends or passes through the nose 370 and is in fluid communication with the passageway 412.

Figure 9A:
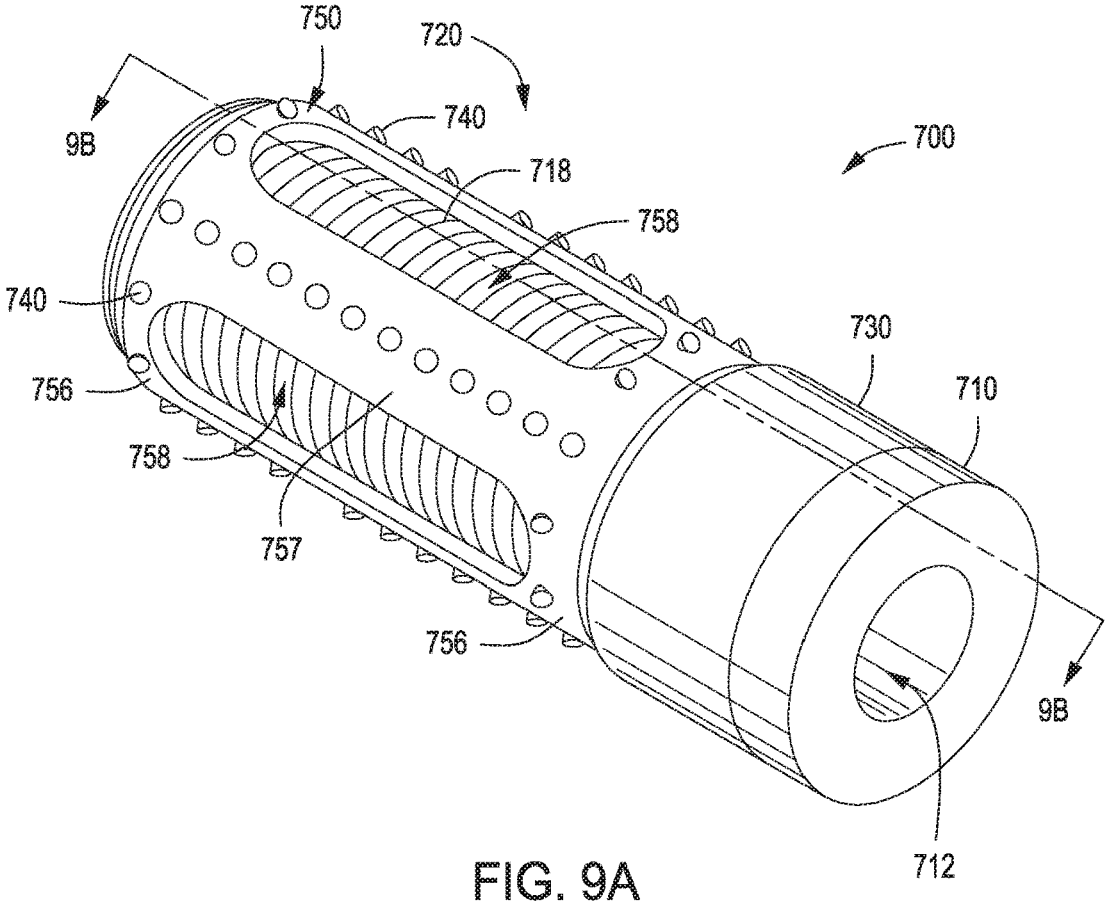
FIGS. 9A and 9B are schematic views of a valve system with an anchor mechanism that can be used in a casing within a downhole environment, according to one or more embodiments.
Figure 9B:
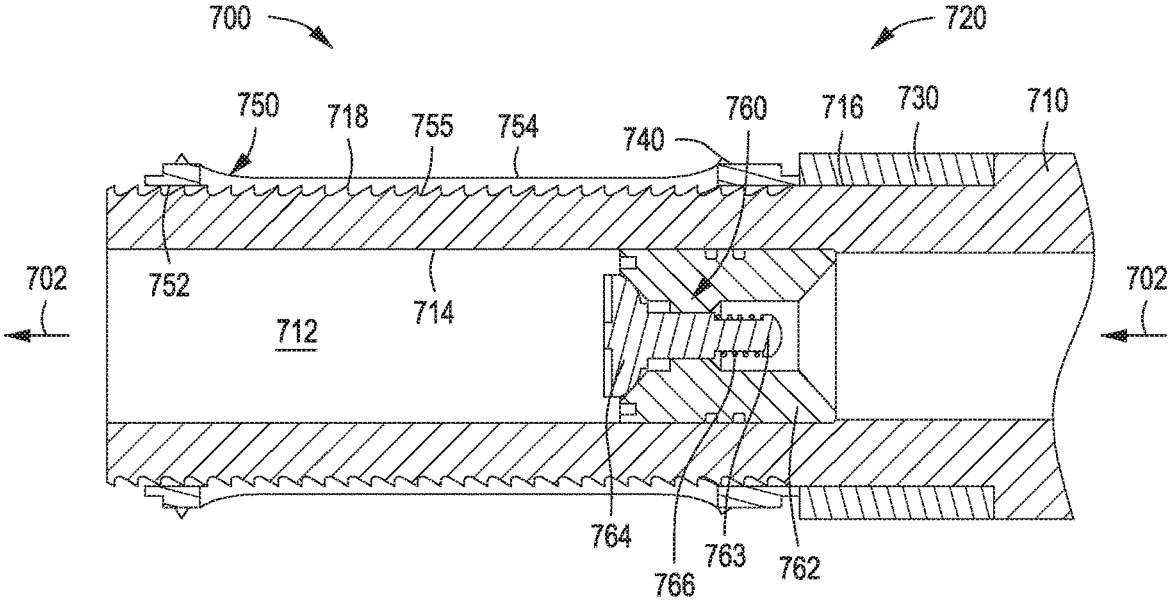

FIGS. 9A and 9B are schematic views of a valve system 700 having an anchor mechanism 720 that can be positioned into a casing that is used in a downhole environment, according to one or more embodiments. The valve system 700 is insertable into the casing or pipe above ground and subsequently, the casing containing the installed valve system 700 is placed into a downhole environment, such as a borehole, a well, and/or a subterranean formation. Alternatively, the valve system 700 can be inserted into and attached inside the casing or pipe that is already positioned in a downhole environment.

The valve system 700 includes a mandrel 710, a setting system 720, and a check valve assembly 760. The mandrel 710 includes the outer surface 716 and an inner surface 714. The inner surface 714 defines a passageway 712 extending or otherwise passing through the mandrel 710. The outer surface 716 includes threading 718.

The check valve assembly 760 is coupled to the mandrel 710 and configured to provide a fluid flow 702 in a primary direction (depicted by arrows in FIG. 9B) through the passageway 712 and to prohibit the fluid flow 702 in a secondary direction (not shown) through the passageway 712 opposite of the primary direction. The check valve assembly 760 can include a valve body 762, a valve stem 763, a plunger 764, an actuator 766 (e.g., spring), and an optional engagement member (not shown). It should be appreciated that the check valve assembly 760 can include other or different components as well. Although the valve system 700 is depicted containing the check valve assembly 760, other types of valves, such as a flapper valve, can substituted for the check valve assembly 760.

As shown in FIG. 9B, fluid flowing along the path of the fluid flow 702 in the primary direction exerts sufficient pressure against the plunger 764 to overcome a force pressing the plunger 764 against the valve body 762. The force pressing the plunger 764 against the valve body 762 includes the actuator 766, as well as fluid pressure from outside of the casing produced from a flowing along a path in the secondary direction opposite of the fluid flow 702 in the primary direction. Whenever the pressure from inside the casing is less than the pressure outside of the casing, the actuator 766 and the outside pressure pushes the plunger 764 into sealing engagement with the valve body 762 therefore prohibiting fluid from flowing along the secondary direction.

The setting system 720 includes one or more sealing elements 730 and an anchor sleeve 750. The sealing element 730 is located on the outer surface 716 of the mandrel 710. The sealing element 730 can be or include, but is not limited to, one or more O-rings, O-seals, packer elements, or any combination thereof. The sealing element 730 can contain one or more polymers, oligomers, rubbers (natural and/or synthetic), silicones, or any combinations thereof. The sealing element 730 forms a gas-tight seal once in sealing engagement with the inner surface of the casing (not shown).

The anchor sleeve 750 is located over the threading 718 on the outer surface 716 of the mandrel 710. The anchor sleeve 750 includes an inner surface 752 and an outer surface 754. A plurality of gripping elements 740 is located on the outer surface 754. The gripping elements 740 can be or include, but are not limited to, one or more slip buttons, one or more teeth, one or more ridges, or one or more threads. The gripping elements 740 extend from the outer surface 754 of the anchor sleeve 750. The gripping elements 740 can extend from the outer surface 754 at an angle (as shown in FIGS. 9A and 9B), or alternative, the gripping elements 740 can extend perpendicular from the outer surface 754 (not shown). The gripping elements 740 are configured to make contact with and grip the inner surface of the casing. Once in contact, the gripping elements 740 produce enough friction against the inner surface of the casing to hold the valve system 700 into place within the casing.

The gripping elements 740 generally contain a material durable enough to withstand the pressures and temperatures experienced downhole in the casing. The gripping elements 740 can contain, but are not limited to, one or more materials that include metal (e.g., cast iron, steel, aluminum, magnesium, or alloys thereof), metal carbide (e.g., tungsten carbide), ceramic, thermoplastic (e.g., phenolic resins or plastic), or any combinations thereof. In one or more examples, the gripping elements 740 are slip buttons and contain a ceramic. In another embodiment, the gripping elements 740 contain a dissolvable material that can be readily dissolved or deteriorated when exposed to an aqueous fluid, such as a cement or a water-based mud, that is an acidic or alkaline. Exemplary dissolvable materials can be or include, but are not limited to, one or more of aluminum, magnesium, aluminum-magnesium alloy, iron, alloys thereof, degradable polymer, or any combination thereof.

The anchor sleeve 750 also includes threading 755 located on the inner surface 752 of the anchor sleeve 750. In some examples, the threading 718 on the outer surface 716 of the mandrel 710 is male threading and the threading 755 on the inner surface 752 of the anchor sleeve 750 is female threading. The anchor sleeve 750 is configured to be bent outwardly from the mandrel 710 to engage the casing with the slip buttons 740.

In one or more embodiments, as depicted in FIG. 9A, the anchor sleeve 750 can include two round end pieces 756 coupled together by a plurality of concentric members 757 which share a common axis with the round end pieces. The concentric members 757 are spaced apart from each other with windows 758 formed through the anchor sleeve 750.

A setting tool is used to engage the anchor sleeve 750 in an axial motion. Upon the relative axial motion, the sealing element 730 and the anchor sleeve 750 are radially moved towards and engage the inner surface of the casing hence locking the valve system 700 into place within the casing.

Figure 10A:
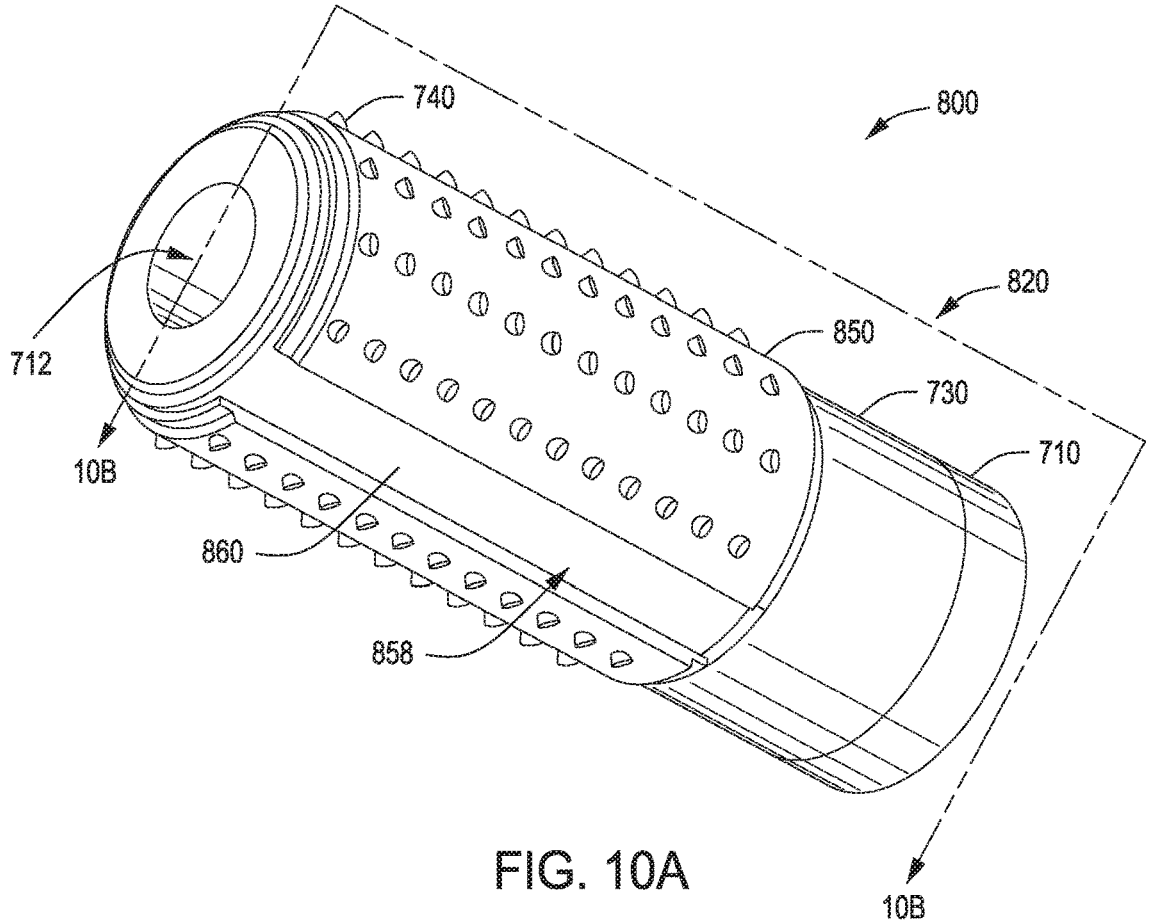
FIGS. 10A and 10B are schematic views of a valve system with another anchor mechanism that can be used in a casing within a downhole environment, according to one or more embodiments.
Figure 10B:
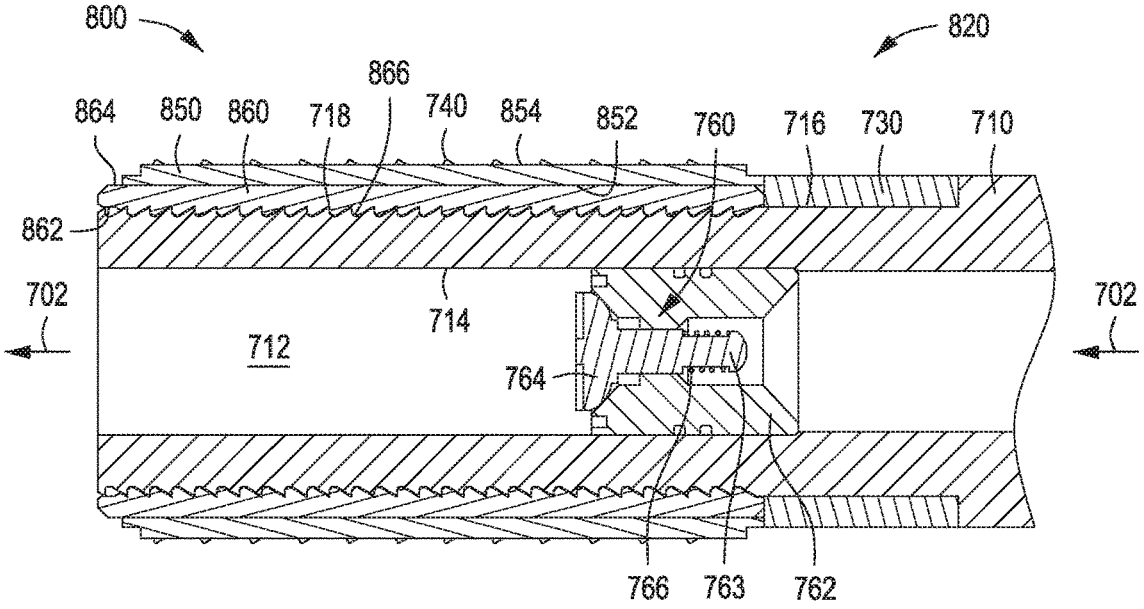

FIGS. 10A and 10B are schematic views of a valve system 800 having an anchor mechanism 820 that can be positioned into a casing that is used in a downhole environment, according to one or more embodiments. The valve system 800 is insertable into the casing or pipe above ground and subsequently, the casing containing the installed valve system 800 is placed into a downhole environment, such as a borehole, a well, and/or a subterranean formation. Alternatively, the valve system 800 can be inserted into and attached inside the casing or pipe that is already positioned in a downhole environment.

The valve system 800 includes a mandrel 710, a setting system 820, and a check valve assembly 760. The mandrel 710 includes the outer surface 716 and an inner surface 714. The inner surface 714 defines a passageway 712 extending or otherwise passing through the mandrel 710. The outer surface 716 includes threading 718.

The check valve assembly 760 is coupled to the mandrel 710 and configured to provide a fluid flow 702 in a primary direction (depicted by arrows in FIG. 10B) through the passageway 712 and to prohibit the fluid flow 702 in a secondary direction (not shown) through the passageway 712 opposite of the primary direction. The check valve assembly 760 can include a valve body 762, a valve stem 763, a plunger 764, an actuator 766 (e.g., spring), and an optional engagement member (not shown). Although the valve system 800 is depicted containing the check valve assembly 760, other types of valves, such as a flapper valve, can substituted for the check valve assembly 760.

The setting system 720 includes one or more sealing elements 730, an anchor sleeve 850, and a threaded sleeve 860. The sealing element 730 is located on the outer surface 716 of the mandrel 710. The sealing element 730 can be or include, but is not limited to, one or more O-rings, O-seals, packer elements, or any combination thereof. The sealing element 730 can contain one or more polymers, oligomers, rubbers (natural and/or synthetic), silicones, or any combinations thereof. The sealing element 730 forms a gas-tight seal once in sealing engagement with the inner surface of the casing (not shown).

The anchor sleeve 850 includes an inner surface 852 and an outer surface 854. A plurality of gripping elements 740 is located on the outer surface 854.

The gripping elements 740 can be or include, but are not limited to, one or more slip buttons, one or more teeth, one or more ridges, or one or more threads. The gripping elements 740 extend from the outer surface 854 of the anchor sleeve 850. The gripping elements 740 can extend from the outer surface 754 at an angle (as shown in FIGS. 10A and 10B), or alternative, the gripping elements 740 can extend perpendicular from the outer surface 854 (not shown). The gripping elements 740 are configured to make contact with and grip the inner surface of the casing. Once in contact, the gripping elements 740 produce enough friction against the inner surface of the casing to hold the valve system 800 into place within the casing.

The setting system 720 includes the threaded sleeve 860 is located between the anchor sleeve 850 and the mandrel 710. The threaded sleeve 860 is located on the threading 718 on the outer surface 716 of the mandrel 710. The threaded sleeve 860 includes an inner surface 862 and an outer surface 864. The inner surface 862 includes threading 866 thereon. The threading 718 on the outer surface 716 of the mandrel 710 is male threading and the threading 866 on the inner surface 862 of the threaded sleeve 860 is female threading.

In one or more embodiments, the anchor sleeve 850 is a C-ring which can have a cylindrical shape and a slot 858 extending the full length of the anchor sleeve 850. The cylindrical shape and the slot 858 provide the anchor sleeve 850 to be radially or outwardly bent away from the mandrel 710 when being set. The slot 858 provides a weak side of the anchor sleeve 850 to reduce the force needed to have the anchor sleeve 850 bend.

A setting tool is used to engage the anchor sleeve 850 and/or the threaded sleeve 860 in an axial motion and apply an axial force to the anchor sleeve 850 sufficient to axially move the anchor sleeve 850 and the threaded sleeve 860. The anchor sleeve 850 presses into the sealing element 730 with axial force. The sealing element 730 in turn presses against a portion of the mandrel 710. Upon receiving the axial force, the sealing element 730, the anchor sleeve 850, and the threaded sleeve 860 are radially moved towards and engage the inner surface of the casing hence locking the valve system 800 into place within the casing (not shown).

During oil and gas production, the process of cementing a casing into the wellbore of an oil or gas well includes several steps. A string of casings is run in the wellbore to the desired depth. Then, a cement slurry is pumped from outside of the wellbore (e.g., ground surface) and into the casing to fill an annulus between the casing and the wellbore wall to a desired height. A displacement medium, such as a drilling or circulation fluid, is pumped behind the cement slurry in order to push the cement slurry to exit the inside of the casing and enter the annulus. The cement slurry is typically separated from the circulation fluid by at least one cementing plug. Due to the difference in specific gravity between the circulating fluid and the cement slurry, the heavier cement slurry initially drops inside the casing without being pumped by hydrostatic pressure. After the height of cement slurry column outside the casing in the annulus equals the height of the cement slurry column inside the casing, hydrostatic pressure must be exerted on the displacement fluid to force the rest of cement slurry out of the casing and into the annulus. After the desired amount of cement slurry has been pumped into the annulus, it is desirable to prevent the backflow of cement slurry into the casing until the cement slurry sets and hardens. This backflow is produced by the difference in specific gravity of the heavier cement and the lighter displacement fluid.

In one or more embodiments, a method of preventing the backflow of cement slurry involves placing a check valve, as discussed and described herein, in the lower end of the casing string to prevent the backflow of the cement slurry and/or other fluids into the casing. The check valve is generally located on a conventional casing string near or at the bottom of the casing string. Then, the cement slurry is pumped through the check valve and into the borehole. As the casing is cemented into place in the downhole or subterranean environment, the check valve prevents fluid flow into the casing from the well or formation. Since the check valve maintains the cement and/or fluid from entering the casing, the casing has more buoyancy and does not need to be supported as much as if the end of the casing was open to backflow. Cement is then pumped down the inside of the casing, out of the check valve, and back up the annulus between the casing and the wellbore wall where the cement is allowed to cure.

In addition to the embodiments described above, embodiments of the present disclosure further relate to one or more of the following paragraphs:

1. A valve system insertable into a casing used in a downhole environment, comprising: a mandrel comprising a passageway therethrough; a check valve assembly coupled to the mandrel and configured to provide a fluid flow only in a primary direction through the passageway; and a setting system comprising: a sealing element located on an outer surface of the mandrel; a pair of wedges located on the outer surface of the mandrel and separated from each other by the sealing element, each of the wedges comprises: an inner surface configured to slide along the outer surface of the mandrel; and an angled surface comprising a first set of ratchet teeth; and a pair of slips located on the mandrel and separated from each other by the pair of wedges, each of the slips comprises: an inner surface comprising a second set of ratchet teeth configured to engage the first set of ratchet teeth on the angled surface of the wedge; and an outer surface comprising gripping elements configured to grip an inner surface of the casing.

2. The valve system of paragraph 1, wherein the first and second sets of ratchet teeth are on angled surfaces such that as the wedges move into the slips to engage the sets of ratchet teeth, the outer surfaces of the slips are moved towards and into engagement with the inner surface of the casing.

3. The valve system of paragraph 2, wherein the first and second sets of ratchet teeth are engageable with each other to movement in a first direction to allow outwardly radial movement of the slips and disallow movement in a second direction and thus prevent inwardly radial movement of the slips.

4. The valve system according to any one of paragraphs 1-3, wherein the gripping elements comprise teeth or slip buttons for gripping the inner surface of the casing.

5. The valve system according to any one of paragraphs 1-4, wherein the gripping elements comprise a material selected from the group consisting of ceramic, metal, metal carbide, thermoplastic, and combinations thereof.

6. The valve system according to any one of paragraphs 1-5, further comprising a set sleeve, a set nut, or a ratcheting lock ring coupled to the mandrel and configured to contain the setting system on the mandrel.

7. The valve system of paragraph 6, wherein the set sleeve, the set nut, or the ratcheting lock ring comprises an orifice in fluid communication with the passageway of the mandrel.

8. The valve system of paragraph 7, wherein the check valve assembly extends through the passageway and the orifice.

9. The valve system according to any one of paragraphs 1-8, further comprising a reamer, a nose, or a shoe coupled to the casing.

10. The valve system of paragraph 9, wherein the reamer or the nose is coupled to the casing and the tool mandrel and operable to contain the setting system on the tool mandrel.

11. The valve system of paragraph 10, wherein the check valve assembly extends through the passageway and into the reamer or the nose.

12. A valve system insertable into a casing used in a downhole environment, comprising: a mandrel comprising a passageway therethrough; a check valve assembly coupled to the mandrel and configured to provide a fluid flow only in a primary direction through the passageway; and a setting system comprising: a sealing element located on an outer surface of the mandrel; a pair of wedges located on the outer surface of the mandrel and separated from each other by the sealing element, each of the wedges comprises: an inner surface configured to slide along the outer surface of the mandrel; and an angled surface; a pair of slips located on the mandrel and separated from each other by the pair of wedges, each of the slips comprises: an inner surface configured to engage the angled surface of the wedge; and an outer surface comprising gripping elements configured to grip an inner surface of the casing; and a ratcheting float collar located around at least a portion of the mandrel adjacent to one of the slips, wherein the ratcheting float collar comprises a first set of ratchet teeth for engaging the mandrel.

13. The valve system of paragraph 12, the mandrel further comprising a second set of ratchet teeth configured to engage the first set of ratchet teeth on the ratcheting float collar.

14. The valve system of paragraph 13, wherein the first and second sets of ratchet teeth are on angled surfaces such that as the wedges move into the slips to engage the sets of ratchet teeth, the outer surfaces of the slips are moved towards and into engagement with the inner surface of the casing.

15. The valve system of paragraph 14, wherein the first and second sets of ratchet teeth are engageable with each other to movement in a first direction to allow outwardly radial movement of the slips and disallow movement in a second direction and thus prevent inwardly radial movement of the slips.

16. The valve system according to any one of paragraphs 12-15, wherein the angled surfaces of the wedges are smooth, wherein the inner surfaces of the slips are smooth, and wherein the angled surface is parallel to the inner surface.

17. The valve system according to any one of paragraphs 12-16, wherein the gripping elements comprise teeth or slip buttons for gripping the inner surface of the casing, and wherein the gripping elements comprise a material selected from the group consisting of ceramic, metal, metal carbide, thermoplastic, and combinations thereof.

18. The valve system according to any one of paragraphs 12-17, further comprising a reamer, a nose, or a shoe coupled to the casing.

19. The valve system of paragraph 18, wherein the reamer or the nose is coupled to the casing and the tool mandrel and operable to contain the setting system on the tool mandrel.

20. The valve system of paragraph 19, wherein the check valve assembly extends through the passageway and into the reamer or the nose.

21. A valve system insertable into a casing used in a downhole environment, comprising: a mandrel comprising a passageway therethrough and threading located on an outer surface of the mandrel; a check valve assembly coupled to the mandrel and configured to provide a fluid flow only in a primary direction through the passageway; and a setting system comprising: a sealing element located on the outer surface of the mandrel; and an anchor sleeve located over the threading on the outer surface of the mandrel, wherein the anchor sleeve comprises an outer surface containing slip buttons, and wherein the anchor sleeve is configured to be bent outwardly from the mandrel to engage the casing with the slip buttons.

22. The valve system of paragraph 21, wherein the anchor sleeve further comprises threading on an inner surface opposite the outer surface.

23. The valve system of paragraph 22, wherein the mandrel threading is male threading and the anchor sleeve inner threading is female threading.

24. The valve system according to any one of paragraphs 21-24, further comprising a threaded sleeve located between the anchor sleeve the threading on the outer surface of the mandrel, wherein the threaded sleeve comprises threading on an inner surface.

25. The valve system of paragraph 24, wherein the threading on the outer surface of the mandrel is male threading and the threading on the inner surface of the threaded sleeve is female threading.

26. The valve system according to any one of paragraphs 21-25, wherein the slip buttons comprise a material selected from the group consisting of ceramic, metal, metal carbide, thermoplastic, and combinations thereof.

27. The valve system according to any one of paragraphs 21-26, wherein the anchor sleeve further comprises two round end pieces coupled together by a plurality of concentric members which share a common axis with the round end pieces, and wherein the concentric members are spaced apart from each other.

28. The valve system according to any one of paragraphs 21-27, wherein the anchor sleeve is a C-ring which comprises a cylindrical shape and a slot extending the full length of the anchor sleeve.

One or more specific embodiments of the present disclosure have been described. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time-consuming, but would nevertheless be a routine undertaking of design, fabrication, and manufacture for those of ordinary skill having the benefit of this disclosure.

In the following discussion and in the claims, the articles "a," "an," and "the" are intended to mean that there are one or more of the elements. The terms "including," "comprising," and "having" and variations thereof are used in an open-ended fashion, and thus should be interpreted to mean "including, but not limited to . . . " Also, any use of any form of the terms "connect," "engage," "couple," "attach," "mate," "mount," or any other term describing an interaction between elements is intended to mean either an indirect or a direct interaction between the elements described. In addition, as used herein, the terms "axial" and "axially" generally mean along or parallel to a central axis (e.g., central axis of a body or a port), while the terms "radial" and "radially" generally mean perpendicular to the central axis. The use of "top," "bottom," "above," "below," "upper," "lower," "up," "down," "vertical," "horizontal," and variations of these terms is made for convenience, but does not require any particular orientation of the components.

Certain terms are used throughout the description and claims to refer to particular features or components. As one skilled in the art will appreciate, different persons may refer to the same feature or component by different names. This document does not intend to distinguish between components or features that differ in name but not function.

Reference throughout this specification to "one embodiment," "an embodiment," "an embodiment," "embodiments," "some embodiments," "certain embodiments," or similar language means that a particular feature, structure, or characteristic described in connection with the embodiment may be included in at least one embodiment of the present disclosure. Thus, these phrases or similar language throughout this specification may, but do not necessarily, all refer to the same embodiment.

Certain embodiments and features have been described using a set of numerical upper limits and a set of numerical lower limits. It should be appreciated that ranges including the combination of any two values, e.g., the combination of any lower value with any upper value, the combination of any two lower values, and/or the combination of any two upper values are contemplated unless otherwise indicated. Certain lower limits, upper limits and ranges appear in one or more claims below. All numerical values are "about" or "approximately" the indicated value, and take into account experimental error and variations that would be expected by a person having ordinary skill in the art.

The embodiments disclosed should not be interpreted, or otherwise used, as limiting the scope of the disclosure, including the claims. It is to be fully recognized that the different teachings of the embodiments discussed may be employed separately or in any suitable combination to produce desired results. In addition, one skilled in the art will understand that the description has broad application, and the discussion of any embodiment is meant only to be exemplary of that embodiment, and not intended to suggest that the scope of the disclosure, including the claims, is limited to that embodiment.

What is claimed is:

1. A valve system insertable into a downhole end of a casing used in a downhole environment before the casing is installed in the downhole environment, comprising:

a mandrel comprising a passageway therethrough;

a check valve assembly coupled to the mandrel and configured to provide a fluid flow only in a downhole direction through the passageway; and a setting system comprising:

a sealing element located on an outer surface of the mandrel;

a pair of wedges located on the outer surface of the mandrel and separated from each other by the sealing element, each of the wedges comprising:

an inner surface configured to slide along the outer surface of the mandrel; and an angled surface comprising a first set of ratchet teeth; and a pair of slips located on the mandrel and separated from each other by the pair of wedges, each of the slips comprising:

an inner surface comprising a second set of ratchet teeth configured to engage the first set of ratchet teeth on the angled surface of the wedge; and an outer surface comprising gripping elements configured to grip an inner surface of the casing, and wherein the setting system is settable from a downhole end of the setting system and setting the setting system comprises axially moving the wedges in the uphole direction.

2. The valve system of claim 1, wherein the first and second sets of ratchet teeth are on angled surfaces such that as the wedges move into the slips to engage the sets of ratchet teeth, the outer surfaces of the slips are moved towards and into engagement with the inner surface of the casing.

3. The valve system of claim 2, wherein the first and second sets of ratchet teeth are engageable with each other to allow movement in a first direction to allow outwardly radial movement of the slips and disallow movement in a second direction and thus prevent inwardly radial movement of the slips.

4. The valve system of claim 1, wherein the gripping elements comprise teeth or slip buttons for gripping the inner surface of the casing, and wherein the gripping elements comprise a material selected from the group consisting of ceramic, metal, metal carbide, thermoplastic, and combinations thereof.

5. The valve system of claim 1, further comprising a set sleeve, a set nut, or a ratcheting lock ring coupled to a downhole end of the mandrel and configured to contain the setting system on the mandrel.

6. The valve system of claim 5, wherein the set sleeve, the set nut, or the ratcheting lock ring comprises an orifice in fluid communication with the passageway of the mandrel, and wherein the check valve assembly extends through the passageway and the orifice.

7. The valve system of claim 1, further comprising a reamer, a nose, or a shoe coupled to the casing.

8. A valve system insertable into a downhole end of a casing used in a downhole environment before the casing is installed in the downhole environment, comprising:

a mandrel comprising a passageway therethrough;

a check valve assembly coupled to the mandrel and configured to provide a fluid flow only in a downhole direction through the passageway; and a setting system comprising:

a sealing element located on an outer surface of the mandrel;

a pair of wedges located on the outer surface of the mandrel and separated from each other by the sealing element, each of the wedges comprising:

an inner surface configured to slide along the outer surface of the mandrel; and an angled surface;

a pair of slips located on the mandrel and separated from each other by the pair of wedges, each of the slips comprising:

an inner surface configured to engage the angled surface of the wedge; and an outer surface comprising gripping elements configured to grip an inner surface of the casing; and a ratcheting float collar located around at least a portion of a downhole end of the mandrel adjacent to one of the slips, wherein the ratcheting float collar comprises a first set of ratchet teeth for engaging the mandrel; and wherein the setting system is settable from a downhole end of the setting system by moving the ratcheting float collar and the wedges in an uphole direction.

9. The valve system of claim 8, the mandrel further comprising a second set of ratchet teeth configured to engage the first set of ratchet teeth on the ratcheting float collar.

10. The valve system of claim 9, wherein the first and second sets of ratchet teeth are on angled surfaces such that as the wedges move into the slips to engage the sets of ratchet teeth, the outer surfaces of the slips are moved towards and into engagement with the inner surface of the casing.

11. The valve system of claim 10, wherein the first and second sets of ratchet teeth are engageable with each other to allow movement in a first direction to allow outwardly radial movement of the slips and disallow movement in a second direction and thus prevent inwardly radial movement of the slips.

12. The valve system of claim 8, wherein the angled surfaces of the wedges are smooth, wherein the inner surfaces of the slips are smooth, and wherein the angled surface is parallel to the inner surface.

13. The valve system of claim 8, wherein the gripping elements comprise teeth or slip buttons for gripping the inner surface of the casing, and wherein the gripping elements comprise a material selected from the group consisting of ceramic, metal, metal carbide, thermoplastic, and combinations thereof.

14. The valve system of claim 8, further comprising a reamer, a nose, or a shoe coupled to the casing.

15. A valve system insertable into a downhole end of a casing used in a downhole environment before the casing is installed in the downhole environment, comprising:

a mandrel comprising a passageway therethrough and threading located on an outer surface of a downhole hole end of the mandrel;

a check valve assembly coupled to the mandrel and configured to provide a fluid flow only in a downhole direction through the passageway; and a setting system comprising:

a sealing element located on the outer surface of the mandrel; and an anchor sleeve located over the threading on the outer surface of the downhole end of the mandrel, wherein the anchor sleeve comprises an outer surface containing slip buttons, and wherein the anchor sleeve is configured to be bent outwardly from the mandrel to engage the casing with the slip buttons, and wherein the setting system is settable from a downhole end of the setting system by moving the anchor sleeve and the wedges in an uphole direction.

16. The valve system of claim 15, wherein the anchor sleeve further comprises threading on an inner surface opposite the outer surface.

17. The valve system of claim 16, wherein the mandrel threading is male threading and the anchor sleeve inner threading is female threading.

18. The valve system of claim 15, further comprising a threaded sleeve located between the anchor sleeve and the threading on the outer surface of the mandrel, wherein the threaded sleeve comprises threading on an inner surface.

19. The valve system of claim 18, wherein the threading on the outer surface of the mandrel is male threading and the threading on the inner surface of the threaded sleeve is female threading.

20. The valve system of claim 15, wherein the slip buttons comprise a material selected from the group consisting of ceramic, metal, metal carbide, thermoplastic, and combinations thereof.

* * * * *